United States Patent [19]

McDermott

[11] Patent Number: 4,570,850

[45] Date of Patent: Feb. 18, 1986

[54] MODULAR CEILING AIR CONTROL DEVICE

[75] Inventor: John McDermott, Elk Grove Village, Ill.

[73] Assignee: MCD Enterprises, Inc., Bensenville, Ill.

[21] Appl. No.: 603,111

[22] Filed: Apr. 23, 1984

[51] Int. Cl.[4] ..... F24F 7/00

[52] U.S. Cl. ..... 236/49; 98/40.01; 98/41.3; 237/46

[58] Field of Search ..... 98/40 D, 40 C, 41 SV, 98/40 VT, 108; 236/49; 237/46

[56] References Cited

U.S. PATENT DOCUMENTS

| | | | |
|---|---|---|---|
| 3,073,525 | 1/1963 | Cislo | 98/41 SV |
| 3,223,019 | 12/1965 | Schuh | 98/40 D |
| 3,308,744 | 3/1967 | Schach | 98/40 D |
| 3,444,894 | 5/1969 | Norelius | 98/108 X |
| 3,537,380 | 11/1970 | Spradling | 98/40 D |
| 4,231,513 | 11/1980 | Vance et al. | 236/49 |

FOREIGN PATENT DOCUMENTS

| | | | |
|---|---|---|---|
| 1403229 | 8/1975 | United Kingdom | 98/40 D |

*Primary Examiner*—William E. Wayner

*Attorney, Agent, or Firm*—Ralph R. Rath; Robert E. Wagner

[57] ABSTRACT

An air control device includes a housing having an inlet and an outlet with fixed and movable plates extending across the inlet that both have indentically configured and spaced openings. The movable plate is moved by a room temperature-sensing device to control the amount of air flow. The outlet has a flow-directing vane for controlling the direction of air flow into a room.

12 Claims, 10 Drawing Figures

MODULAR CEILING AIR CONTROL DEVICE

DESCRIPTION

1. Technical Field

The present invention relates generally to air control devices and, more particularly, to a modular air control device that is capable of controlling air flow to individual rooms in a building.

2. Background Prior Art

With the advent of the energy crisis in recent years, numerous developments have occurred in the field of controlling air flow into various rooms of buildings to control temperature. Several types of modular units have been developed which can provide individual control to the respective rooms of an office building to reduce the power and, thus, the energy requirements for maintaining a predetermined temperature within the room.

For example, Carrier Corporation originally produced and still produces an air terminal consisting of an elongated duct that has an outlet opening with plug-in accessory control packages that provide constant volume or variable volume control capability for each individual unit supplying controlled air to the various rooms of the building. However, one of the problems encountered with a unit of this type is the fact that static pressure variations will result in irregular volumetric flow through the system. Thus, it becomes necessary to have an input volume pressure control to provide an adequate output from the unit. A unit of this type is expensive to manufacture and requires various control systems for providing constant volume or variable volume control to be capable of having a substantially linear output of volume of flow from the unit.

More recently, Temp-Master has been manufacturing and selling a modular-controlled diffuser unit which operates under substantially less static pressure than equipment that has been distributed by Carrier Corporation. However, this equipment again requires rather elaborate control systems requiring various wiring for the control mechanisms.

More recently, self-contained units requiring no external wiring or external connections have been developed by various manufacturers but, in all instances, the construction thereof is complicated in nature and is not energy efficient.

Thus, there remains a need for a modular self-contained unit that does not require any external power source and produces a substantially-linear volumetric flow in terms of percentage of dampening control and one in which the unit can maintain this linear relationship without any control of the static input pressure from the main source of air flow.

SUMMARY OF THE INVENTION

According to the present invention, a modular ceiling air control device has been developed which is capable of being operated at substantially lower static pressures and horsepower than modular units that are presently in existence. The air control device is designed to be capable of being operated with a low pressure duct system without any pneumatic tubing or electrical wiring for controlling the system.

More specifically, the air control device for controlling the air flow into a room includes a housing having an inlet and an outlet with a fixed plate extending across the inlet and having a plurality of spaced openings therein. A movable plate is slidably supported on the fixed plate and has spaced openings that are equal in number, and configured and spaced corresponding to the spacing of the openings in the fixed plate with temperature responsive means connected to the movable plate that senses the room temperature and moves the movable plate as a function of the room temperature.

According to one aspect of the invention, the air control device also has a deflector means adjacent the outlet that is pivoted about a fixed axis to a plurality of positions that control the direction of the air flow. The deflector device is in the form of a triangular vane that is pivoted on a fixed axis and is movable between three positions with the outlet area for the air flow being substantially constant in each of the positions so that there is no pressure variance in the device in any of the adjusted positions for the deflector.

According to a further aspect of the invention, the air control device may also incorporate an inlet air temperature sensing means for sensing the inlet air temperature and moving the movable plate to a maximum flow position when the inlet air temperature is above a selected level.

The air control device may also include separate heating means within the housing for heating the air flowing through the housing and a temperature-responsive means for moving the movable plate to a maximum flow position whenever the heating means is actuated. The heating means may be in the form of an electrical coil with a solenoid for operating the electrical coil, as well as moving the movable plate to the maximum flow position.

BRIEF DESCRIPTION OF SEVERAL VIEWS OF DRAWINGS

Figure 4A:
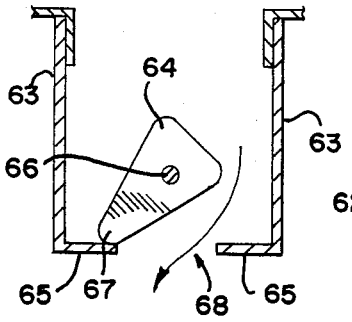
Figure 4B:
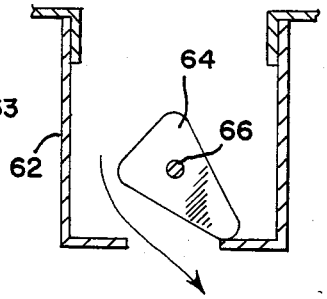
Figure 4C:
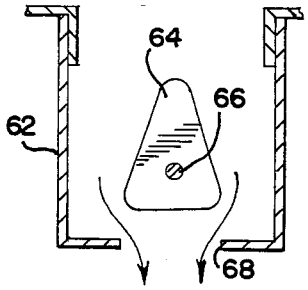
Figure 5:
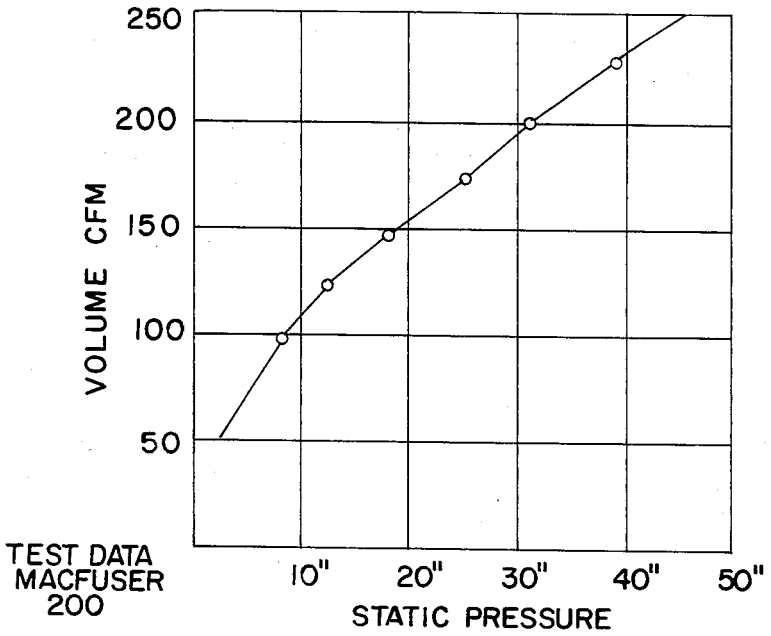
Figure 6:
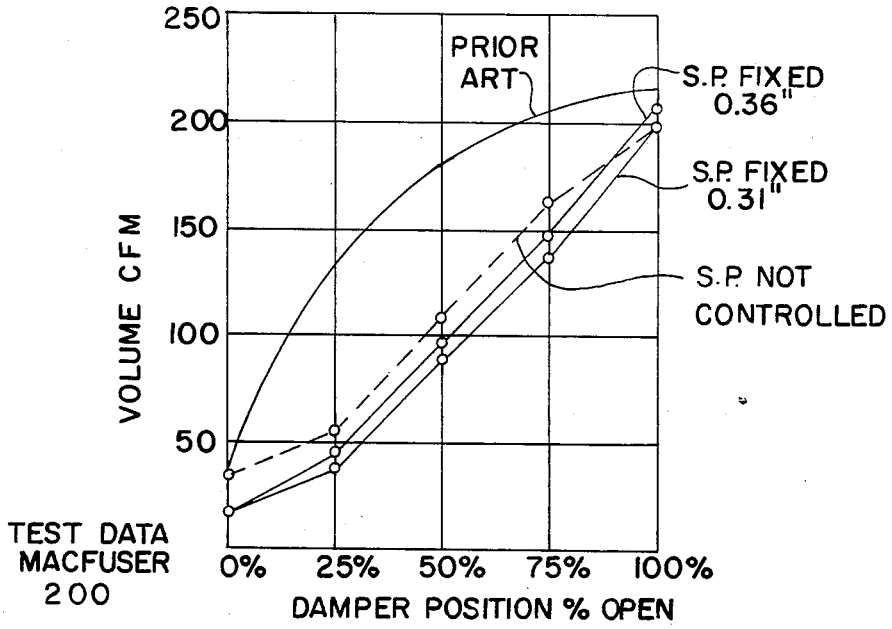
Figure 7:
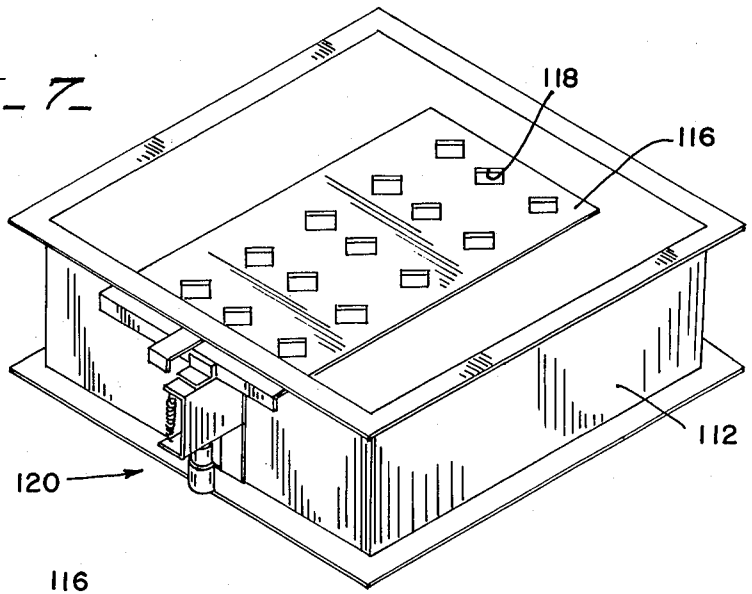
Figure 8:
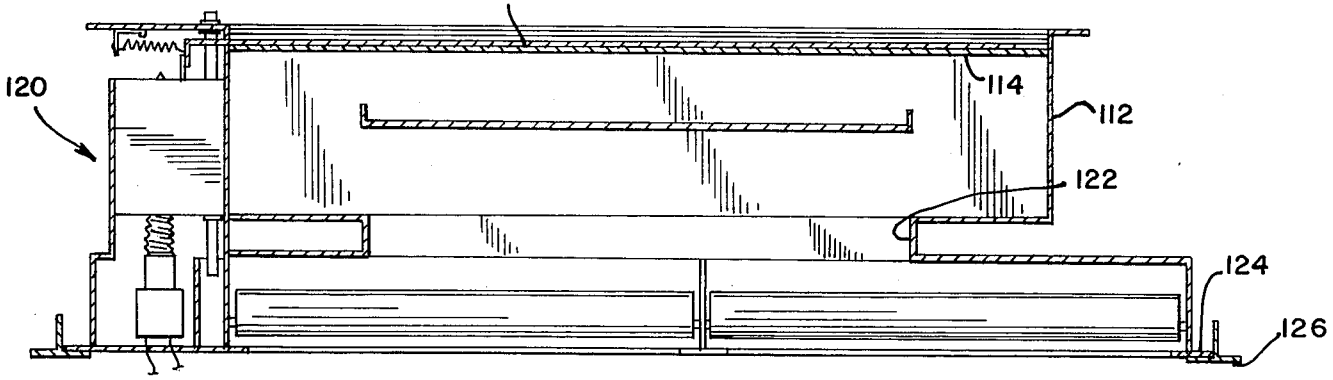

FIGS. 4(*a*), (*b*) and (*c*) are identical views showing the deflector means in three different positions for controlling the direction of air flow;

FIG. 5 is a graph showing the static pressure variation when compared with the volume of air flow through the device;

FIG. 6 is a chart comparing the air flow through the device for various damper positions;

FIG. 7 is a perspective view of a modified form of air control device; and,

FIG. 8 is a cross-sectional view as viewed along line 8—8 of FIG. 7.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1:
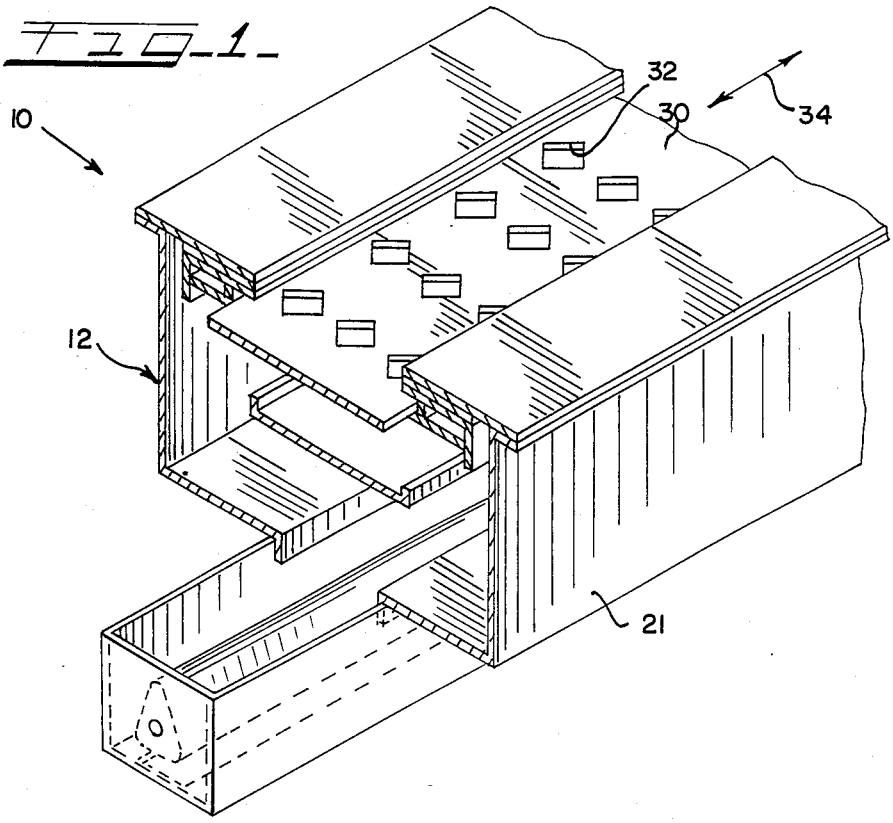
FIG. 1 is a fragmentary perspective view of the air control device constructed in accordance with the present invention.
Figure 2:
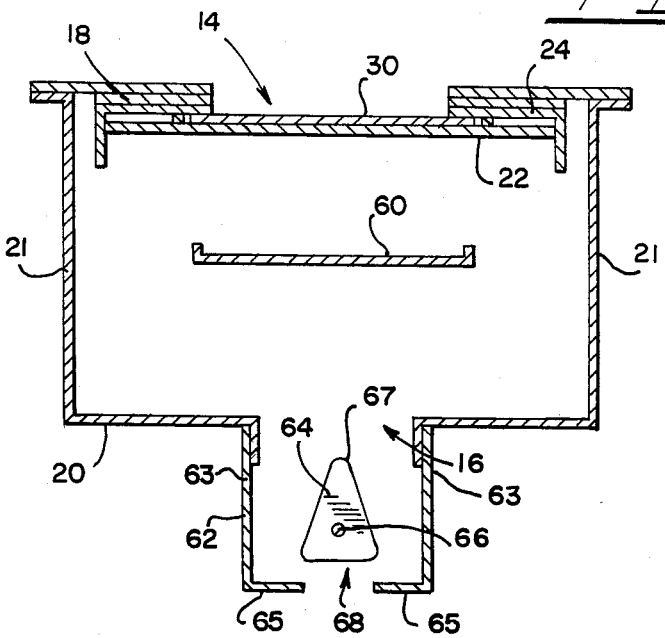
FIG. 2 is a cross-sectional view of the air control device shown in FIG. 1.

FIGS. 1 and 2 of the drawings show the air control device constructed in accordance with the teachings of the present invention and generally designated by the reference numeral 10. The air control device 10 consists of a generally elongated rectangular housing 12 having an inlet 14 and an outlet 16 respectively located in the upper and lower walls 18 and 20 of the housing which are connected by side walls 21. A fixed plate 22 extends across the inlet 14 and is supported on the upper wall 16 by a pair of brackets 24. The fixed plate has a plurality of spaced openings (not shown), the configuration of which will be described later. The air control device also includes a movable plate 30 that is slideably supported between the brackets 24 and fixed plate 22. The movable plate 30 has a plurality of openings 32 which are identical in spacing and configuration to the openings in the plate and the movable plate is adapted to be moved between fully opened and fully closed positions wherein the openings 32 in the plate are aligned with the openings in the fixed plate 22 and where the openings are totally offset between the movable and the fixed plates.

According to the invention, the openings 32 are configured to produce a linear relation between the volume of air flow in relation to the percentage of open portion of the movable plate in FIG. 1, the openings in both plates are diamond-shaped as viewed in the direction of movement of the movable plate, indicated by the arrows 34.

Figure 3:
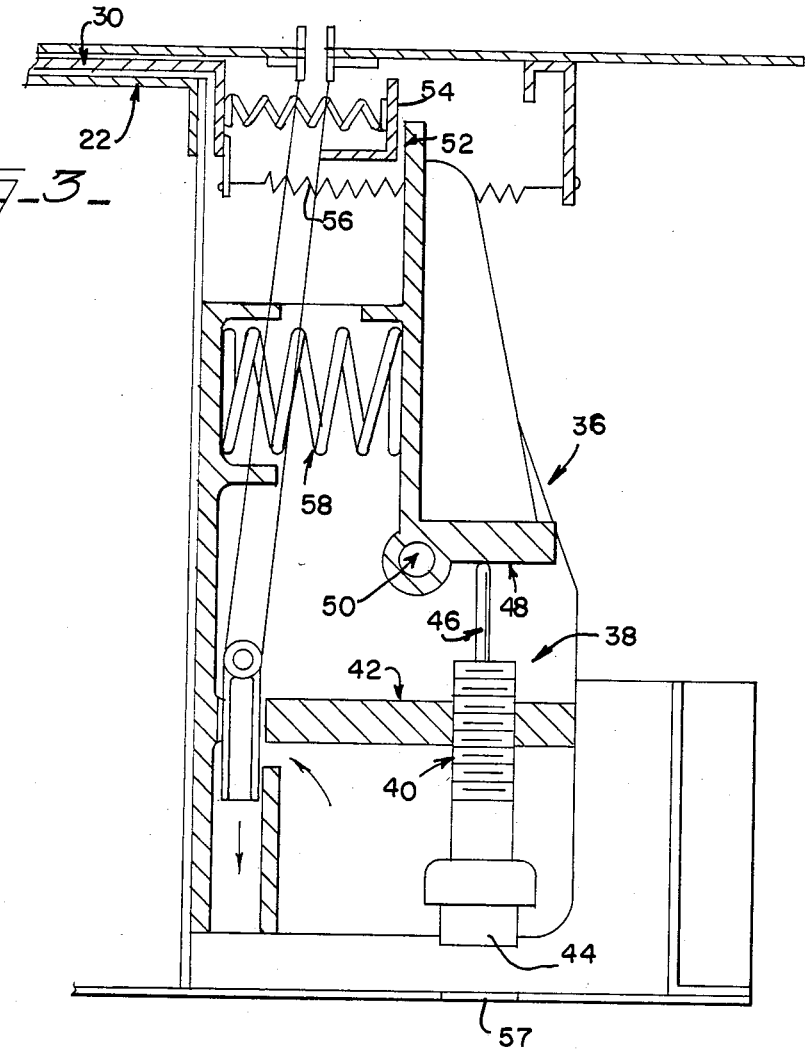
FIG. 3 is a cross-sectional view of the thermal control unit for the air control device.

According to one aspect of the present invention, the movable plate 30 is moved between the fully open and fully closed positions by a temperature-responsive means 36 (FIG. 3) located adjacent one end of the housing 12. The temperature responsive means 36 is illustrated in FIG. 3 and consists of a thermally-controlled thermostat 38 that includes a threaded support member 40 supported on a fixed plate 42 that forms part of the housing 12 and has a thermal sensing device 44 on one end thereof. The thermal sensing device is designed to move a rod or member 46 within the fixed member 40 as a function of the room temperature that is sensed. The free end of the member 46 is in engagement with a link 48 that is pivoted about a fixed axis 50 in housing 12 and has an arm 52 extending therefrom. The arm 52 is in alignment with a bracket 54 that is integral with the one end of the movable plate 30. Both the arm 52, along with plate 30, and link 48 are biased to a first closed position by respective springs 56 and 58.

With the mechanism so far described, the thermostat, which is isolated from the chamber defined by the housing, senses the room temperature and, when there is a rise in temperature within the room beyond the desired setting, the member 46 is moved upwardly and pivots link 48 about pivot pin 50 to move the movable plate 30 to the left and produce a partial opening created by partial overlap of the openings in the fixed plate and the movable plate. The amount of movement will be dependent upon the differential in temperature sensed and the setting of the thermostat for the desired temperature within the room. The desired temperature is pre-set at the factory level, but can be changed merely be inserting a screwdriver through an opening 57 and moving the support member 40 with respect to plate 42.

In order to maintain a predetermined pressure drop between the inlet 14 and outlet 16, the air control device preferably has a deflector plate 60 (FIG. 2) which partially blocks part of the cross-sectional area between the inlet and the outlet. The deflector or diffuser plate extends the entire length of the housing and restricts the cross-sectional area for fluid flow.

According to a further aspect of the present invention, the air control device 10 also incorporates deflector means for controlling the direction of the air flow through the outlet. Preferably, the deflector means is formed as a separate element or attachment for attaching to the outlet of the main housing so that the air control device can be manufactured and sold with or without the deflector means. The deflector means consists of an elongated casing 62 having a pair of depending walls 63 terminating in inwardly extending lips 65 defining outlet 68. The deflector means also includes a deflector means 64 in the form of a triangular vane having an apex 67 pivoted about a fixed axis 66 within casing 62. A lower outlet opening 68 is formed in the casing and defines an elongated slot outlet. As shown in FIGS. 4(*a*), (*b*) and (*c*), the deflector has three different positions which respectively direct air flow towards the left, towards the right and downwardly, as shown in the respective Figures. One of the novel aspects of the deflector means is the fact that the vane 64 is constructed, configured and positioned such that the total cross-sectional area of outlet 68 is the same for each of the positions. It will be appreciated from an inspection of FIGS. 4(*a*), (*b*) and (*c*), in the first position, the air flow on the left-hand side of the vane is blocked and all of the air flow must go through the right-hand or between the right-hand edge of the vane and the casing 62. The same is true in the second position, illustrated in FIG. 4(*b*) where the right-hand side is blocked and all of the flow is between the left-hand edge of the vane and the casing. In the third position, one-half of the total cross-sectional area of flow is located between the left-hand edge of the vane and the casing and one-half of the flow is between the right-hand edge of the vane and the casing. However, the total cross-sectional area of the two spaces is equal to the cross-sectional area of the outlet.

Of course, since the deflector means is in the form of an attachment, it can easily be utilized separately in some other system or as a part of the disclosed air control device.

FIGS. 5 and 6 show two different charts comparing the static pressure at the inlet to the air control device and the resulting volume of flow in cubic feet per minute. FIG. 6 shows the linear relationship of the volume of flow when compared with the percentage of opening area of the air control device and also indicates that the linear relationship is maintained without any necessity of controlling the inlet static pressure. This linear relation results from the diamond configuration of the openings 32.

FIG. 6 also shows a prior art type of dampening arrangement which indicates that when the damper is moved to an approximately half-closed and half-open position, approximately 75% of the air volume through the unit is flowing in this position.

Several additional features may be incorporated into the air control device for all-season air control of a room. The air control unit can include a second thermostat located on the housing and connected to the movable plate. This second thermostat senses the inlet air temperature and moves the movable plate to a maximum flow position whenever the inlet air temperature is above a certain level which then heats the room.

The unit may also incorporate an internal heating means for early morning warmup of the incoming air. The internal heating means preferably includes an electric coil located within the housing and is actuated through a solenoid which moves the movable plate to a maximum flow position when heating is required A slightly modified unit is illustrated in FIGS. 7 and 8 wherein the air control device is generally indicated by reference numeral 110. The unit 110 consists of a generally square housing 112 that is configured to be supported within the normal grid-type ceiling structure that supports square panels so that the unit can be installed merely by removing one of the ceiling tiles and replacing it with unit 110. A fixed plate 114 that covers approximately one-half of the total cross-sectional area of the unit and again has the diamond-shaped openings. A movable plate 116 having openings 118 spaced and configured identical to the openings in fixed plate 114, is located above the fixed plate and the movement of the plate is controlled by a temperature-responsive means 120 that is similar in construction to the one disclosed and described with respect to FIG. 3.

The unit also has an outlet 122 and a outwardly-directed flange 124 extending from the housing 112 and resting on T-support elements 126.

As can be appreciated from the above description, the present invention provides an inexpensive efficient individual room-control unit that can easily be installed in any existing building air control system. It should be noted that while the deflector mechanism has been shown as part of the air control unit, it has separate utility and could be used in existing ducting which has sloted outlets.

I claim:

1. An air control device for controlling air flow into a room comprising a housing having an inlet and an outlet, a fixed plate extending across said inlet and having a plurality of spaced openings therein, a movable plate slideable on said fixed plate and having openings spaced and corresponding to the spaced openings in said fixed plate and means for moving said movable plate as a function of room temperature, said means for moving including a spring extending from said movable plate to said housing for biasing said movable plate relative to said fixed plate with the spaced openings of the two plates offset from one another to stop air flow therethrough, and a temperature sensitive means acting against said spring to at least partially align said spaced openings of the two plate at a desired temperature to provide air flow therethrough, heating means in said housing for heating air flowing through said housing and means responsive to actuation of said heating for moving said movable plate to a maximum air flow position.

2. An air control device as defined in claim 1, in which said housing is generally elongated and rectangular and said outlet is an elongated slot extending substantially between opposite ends of said housing.

3. An air control device as defined in claim 2, in which said movable plate is generally rectangular and is movable along an axis between opposite ends and in which said openings are diamond-shaped in cross-section as viewed along said axis.

4. An air control device as defined in claim 1, in which said housing is generally square in cross-section and said fixed and movable plates are elongated and rectangular and cover less than the total cross-sectional area of said housing.

5. An air control device as defined in claim 1, in which said temperature sensitive means includes a temperature-sensing device for sensing room temperature and having a member movable in response to changes in room temperature and linkage means between said member and said movable plate.

6. An air control device as defined in claim 1, in which said heating means is an electric coil.

7. An air control device as defined in claim 1, in which said movable plate is movable along a fixed path and said openings are diamond-shaped with respect to said path.

8. A modular ceiling air control device comprising an elongated housing having an inlet and a casing extending to and defining an elongated outlet slot, a fixed plate extending across said inlet and having a plurality of spaced openings therein, a movable plate slidable along an axis on said fixed plate and having openings equal in number and spacing to said openings in said fixed plate, temperature-responsive means connected to said movable plate for sensing room temperature and moving said movable plate as a function of room temperature, and deflector means pivoted about a fixed axis extending longitudinally of and adjacent said elongated outlet slot controlling the direction of air flow through said outlet slot, said deflector means having a shape proportioned to said casing and said outlet slot so that the air flow through said casing and outlet slot is substantially constant irrespective of the pivotal position of said deflector means about said fixed axis.

9. A modular ceiling air control device as defined in claim 8, in which said deflector means includes a member triangular in cross-section that is pivoted between three different positions for directing air flow in these different directions through said outlet.

10. A modular ceiling air control device as defined in claim 8, further including temperature-sensing means for sensing inlet air temperature and means for moving said movable plate to a maximum flow position when the inlet air temperature is above a selected limit.

11. A modular ceiling air control device as defined in claim 8, further including heater means in said housing and means responsive to operation of said heater means for moving said movable plate to a maximum flow position.

12. An air control device for controlling air flow into a room comprising a housing having an inlet and an outlet, a fixed plate extending across said inlet and having a plurality of spaced openings therein, a movable plate slideable on said fixed plate and having openings spaced and corresponding to the spaced openings in said fixed plate, means for moving said movable plate as a function of room temperature, said outlet being an elongated slot with a vane pivoted in said slot, said vane being triangular in cross-section and having three pivoted positions and in which the cross-sectional area for air flow through the outlet is sbustantially identical for each of said positions.

* * * * *